US006095635A

United States Patent [19]

Kinoshita et al.

[11] Patent Number: 6,095,635

[45] **Date of Patent: *Aug. 1, 2000**

[54] DISCHARGED INK TREATING METHOD, RECOVERY DEVICE FOR CARRYING OUT THE SAME AND INK DISCHARGE DEVICE

[75] Inventors: Hiroyuki Kinoshita, Kawasaki; Tetsuo Suzuki, Yokohama; Masahiro Taniguro, Yokohama; Hiroyuki Saito, Yokohama; Koichi Tanno, Kawasaki; Haruyuki Yanagi, Machida; Makoto Kawarama, Ayase; Masaya Shinmachi; Tan At Ming, both of Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/801,420

[22] Filed: Feb. 18, 1997

Related U.S. Application Data

[63] Continuation of application No. 08/293,434, Aug. 22, 1994, abandoned.

[30] Foreign Application Priority Data

Jan. 25, 1994 [JP] Japan ..... 6-006589
Aug. 4, 1994 [JP] Japan ..... 6-183399

[51] Int. Cl.[7] ..... B41J 2/165

[52] U.S. Cl. ..... 347/36; 347/22; 347/35

[58] Field of Search ..... 347/22, 23, 24, 347/29, 30, 31, 32, 33, 35, 36

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,893,138 | 1/1990 | Terasawa et al. | 346/140 R |

(List continued on next page.)

FOREIGN PATENT DOCUMENTS

| | | | |
|---|---|---|---|
| 0110634 | 6/1984 | European Pat. Off. | B41J 2/165 |
| 0261916 | 3/1988 | European Pat. Off. . | |
| 0356763 | 3/1990 | European Pat. Off. . | |
| 0395403 | 10/1990 | European Pat. Off. . | |
| 0436964 | 7/1991 | European Pat. Off. . | |
| 0442528 | 8/1991 | European Pat. Off. | B41J 2/185 |
| 442528 | 8/1991 | European Pat. Off. . | |
| 0578124 | 1/1994 | European Pat. Off. . | |
| 3042997 | 7/1982 | Germany | B41J 2/185 |
| 54-056847 | 5/1979 | Japan . | |
| 57-193369 | 11/1982 | Japan | 347/35 |
| 59-45162 | 3/1984 | Japan | B41J 3/04 |
| 59-123670 | 7/1984 | Japan . | |
| 59-138461 | 8/1984 | Japan . | |
| 60-071260 | 4/1985 | Japan . | |
| 3-151247 | 6/1991 | Japan | B41J 2/18 |
| 4161081 | 6/1992 | Japan . | |
| 4-211963 | 8/1992 | Japan . | |
| 87-04979 | 8/1987 | WIPO | B41J 3/04 |

*Primary Examiner*—John Barlow
*Assistant Examiner*—Craig A. Hallacher
*Attorney, Agent, or Firm*—Fitzpatrick, Cella, Harper & Scinto

[57] ABSTRACT

This invention provides a discharged ink treating method for destroying or dispersing ink deposit created on a discharged ink receiving portion side, by the use of a mechanically operated member. A method of treating discharged ink from an ink using portion using liquid ink has the step of destroying or dispersing ink deposit created in a discharged ink path along which the discharged ink passes from the ink using portion to a discharged ink receiving portion and on the discharged ink receiving portion side, by the use of a mechanically operated member.

50 Claims, 10 Drawing Sheets

U.S. PATENT DOCUMENTS 5,018,884 5/1991 Hirano et al. ..... 400/126
5,084,712 1/1992 Mock et al. ..... 346/1.1
5,103,244 4/1992 Gast et al. ..... 347/33
5,221,935 6/1993 Uzita ..... 347/36
5,245,362 9/1993 Iwata et al. ..... 347/30
5,280,603 1/1994 Jeppson et al. ..... 395/425

DISCHARGED INK TREATING METHOD, RECOVERY DEVICE FOR CARRYING OUT THE SAME AND INK DISCHARGE DEVICE

This application is a continuation of application Ser. No. 08/293,434 filed Aug. 22, 1994, now abandoned.

BACKGROUND OF THE INVENTION

1. Field of the Invention

This invention relates to a discharged ink treating method for a unit using an ink using portion such as a recording head for discharging liquid ink to thereby record an image on a recording medium, and an ink discharge device having a step or a mechanism for collecting into a liquid absorbing member or a collecting portion the ink discharged by pressing or suction to preliminarily discharge or recover the ink from the recording head as the ink using portion.

Also, the present invention relates to an invention which can be applied to a recording apparatus having the function of a printer, a copying apparatus, a facsimile apparatus or the like, or a recording apparatus used as the output instrument of a compound type electronic apparatus including a computer, a word processor, etc. or a work station, or an apparatus for recording images on a recording medium such as paper or a plastic sheet on the basis of image information.

2. Related Background Art

In a recording apparatus of the serial type adopting a serial scan system in which main scanning is effected in a direction intersecting the conveyance direction of a recording medium (the sub-scanning direction), the operation of recording (main scanning) an image by recording means carried on a carriage moved along the recording medium, completing the recording of a line, thereafter effecting a predetermined amount of paper feeding (pitch conveyance), and thereafter again recording (main scanning) the image of the next line on the recording medium stopped is repeated, whereby the recording on the whole recording medium is effected.

On the other hand, in a recording apparatus of the line type which effects recording by only the sub-scanning in the conveyance direction of a recording medium, the operation of setting the recording medium at a predetermined recording position, effecting the recording of a line in block, thereafter effecting a predetermined amount of paper feeding (pitch feeding) and further effecting the recording of the next line in block is repeated, whereby the recording on the whole recording medium is effected.

Of these recording apparatuses, a recording apparatus of the ink jet type (an ink jet apparatus) typical as a recording system using liquid ink is one in which ink is discharged from recording means (a recording head) onto a recording medium to thereby effect recording, and has the advantages that it is easy to make the recording means compact, that highly minute images can be recorded at a high speed, that recording can be effected on plain paper without the plain paper being subjected to any special treatment, and that running cost is low and noise is little because of the apparatus being of the non-impact type and moreover it is easy to record colored images by the use of polychromatic ink. Above all, an apparatus of the line type using recording means of the line type in which a number of discharge ports are arranged in the widthwise direction of paper can accomplish a higher speed of recording.

Particularly, recording means (a recording head) of the ink jet type which discharges ink by the utilization of heat energy leads to the ease of manufacturing one having a liquid pa th arrangement (discharge port arrangement) of high density by forming an electro-thermal conversion member formed as film on a substrate, an electrode, liquid path walls, a top plate, etc. by way of a semiconductor manufacturing process including etching, vapor deposition, sputtering, etc., and enables the apparatus to become more compact. On the other hand, there are various requirements for the material of the recording medium, and in recent years, it has become required that use can be made of thin paper and worked paper (such as punched paper for filing, perforated paper or paper of any shape) besides paper which is ordinary recording medium and resin sheets (such as OHP).

Generally, a recovery process for stabilizing the ink discharge characteristic of an ink jet head as an ink using portion used in an ink jet apparatus [the process of effecting ink discharge by suction from a discharge port through a hermetically sealing cap, the process of effecting ink discharge from the discharge port by the pressing from an ink supply side or the process of driving an ink discharging element by data for recovery discrete from data for recording to thereby effect ink discharge from the discharge port (hereinafter referred to as the preliminary discharge)] is carried out at a preliminary stage for image formation, at a predetermined period during image formation or after image formation, or at a predetermined period conforming to the period during which the apparatus is left unused, or at any timing.

An example of such apparatus will hereinafter be described with reference to FIG. 7 of the accompanying drawings. FIG. 7 is a perspective view illustrating an ink jet apparatus according to the prior art. A recording head 101 for discharging ink from a discharge port in an ink discharge surface 101*a* to thereby record an image on a recording medium 105 is carried on a carriage 102. This carriage 102 is supported by a guide shaft 103 for guiding the carriage in the direction of movement and is reciprocally moved while being opposed to the recording medium 105. The recording medium 105 is urged against a feed roller by a pinch roller and is conveyed by the feed roller being rotated. Further, after image formation, the recording medium 105 is discharged outwardly of the recording apparatus by a discharge roller. (The pinch roller, the feed roller and the discharge roller are not shown.)

Any foreign substance such as paper powder adhering to the ink discharge surface 101*a* and any excess ink are wiped off by a wiper 104 provided outside the image forming area (wiping operation). Also, a cap 106 and a suction pump are provided to prevent the clogging of the discharge port by covering the discharge surface 101*a* and to such the ink from the exterior of the recording head. In order to maintain and recover the ink discharging performance of the recording head, the above-described wiping and preliminary ink discharging operations are performed, for example, after the lapse of a predetermined time (e.g. 60 seconds) during the image output or at predetermined timing during the closing of a power source switch or the like. Also, the cap closing operation is performed, for example, before the cutting-off of the power source or after the lapse of a predetermined time (e.g. 60 seconds) after an image output signal is interrupted. Also, the ink sucking operation is designed to be performed a predetermined time (e.g. about three days) after or by the user's operation in order to remove any bubbles created in a head flow path with time. In the present example, the discharged ink discharged from the head is collected in a cassette, but alternatively may be discharged into a discharged ink receiving container provided in the apparatus or to a preliminary discharge area in which an absorbing member is located, and in such case, the discharged ink can reach a predetermined discharged ink absorbing member and be absorbed and retained thereby.

In the example of the prior art shown in FIG. 7, use is made of a construction (not shown) in which an ink cartridge itself having recording liquid ink in a bag is provided with a discharged ink absorbing member for absorbing and collecting the discharged ink. The details of this construction are described in Japanese Laid-Open Patent Application No. 4-211963 (U.S. Pat. No. 5,221,935 and EP Laid-Open Application 0442528). This publication recognizes the problem that when the discharged ink is directly given to the absorbing member, the ink absorbed in the absorbing member dries and the absorbing member cannot absorb the ink and the discharged ink in liquid state leaks from the ink cartridge, and solves this problem by increasing a portion in which the absorbing member can cope with the discharged ink.

On the other hand, in recent years, ink recording has been in the tendency that various additives are added to make the image quality characteristic after the recording with liquid ink good, and use has been made of ink which can shorten the time for which liquid ink solidifies and provides an image (i.e. ink excellent in adhering property).

Further, ink image has been regarded as more preferable if it is excellent in water-resisting property which refers to the degree to which image quality can be maintained against water such as rain and if it is excellent in light-resisting property which refers to the degree to which image quality can be maintained against light such as sunlight, but has been backward in the application to mounting. Ink development has been singly done to enhance such kind of performance, and water-resisting ink having many water-resisting dyes has been provided and pigment ink also excellent in light-resisting property has been provided.

However, even if as in the prior art described above, design is made to disperse the discharged ink receiving area of the ink absorbing member so as to enable the ink absorbing ability of the ink absorbing member itself to be utilized to its maximum, the use of the ink improved in characteristic such as water-resisting property, light-resisting property or adhering property has given rise to the following new problems.

That is, it has been found that before the ink itself is absorbed by the ink absorbing member, an increase in viscosity or adhesion takes place on the surface of the ink absorbing member and color materials such as pigments or dyes pile and the solvent in the ink remains and continues to pile among those color materials, thereby forming a heap. This phenomenon has been seen to cause a case where if as in the prior art, an attempt is made to collect the discharged ink from the last end portion of the discharged ink guide path of a suction pump or the like into the absorbing member, the deposition of ink in a heap state is formed between this last end portion and the absorbing member and that last end portion is shut up by the growth of the deposition of ink. Also, when the conventional preliminary discharge or pressing recovery is effected, the ink is discharged to a predetermined location and therefore, the growth of this deposition becomes remarkable. Particularly, when the recording means as the ink using portion is adapted for use with a plurality of colors, the discharged ink therefrom increases double and therefore the growth of the deposition thereof is remarkable, and it has been found that the more improved is the ink characteristic, the more remarkable becomes the growth speed.

Particularly, in a case where the ink jet recording head is of the scanning type or a case where the full line recording head is moved from a recording position to a position opposed to the absorbing member to thereby effect preliminary discharge so as to collect the discharged ink, it has been experienced that when the head is moved to the preliminary discharge area, that movement is disturbed or the surface of the head is injured to cause the problem of the head itself such as unsatisfactory discharge.

Also, in recent years, in contrast with the ink jet recording apparatus, there has been provided an apparatus in which different ink jet heads (for example, a plurality of color recording heads and a monochromatic recording head) are made interchangeable to thereby effect different records. However, when such different recording heads are used, the above-noted problem may not arise in the case of a single recording head, but yet may arise in the case of the ink of other recording head. Thus, it is preferable that as the apparatus body, design be made such that the above-noted problem will not arise whatever ink may come.

SUMMARY OF THE INVENTION

It is a primary object of the present invention to solve at least one of the above-noted problems and to provide a discharged ink treating method of treating discharged ink from an ink using portion using liquid ink and wherein in a discharged ink path along which the discharged ink passes from the ink using portion to a discharged ink receiving portion, the deposition of the ink created on the discharged ink receiving portion side is destroyed or dispersed by the use of a mechanically operated member.

Also, particularly when ink of high adhering property or high thickening property such as water-resisting ink is used in the ink using portion of the apparatus and preliminary discharge is effected during the above-described recovery process, thickened ink is deposited on the ink flow path in the preliminary discharge area and on the discharged ink absorbing member and finally heaps high to thereby contact with other member such as the head discharge surface as the ink using portion, thus causing damage to and unsatisfactory operation of the head surface.

The present invention has been made in order to solve such a problem and an object thereof is to provide an ink jet apparatus in which the growth of he deposition or the deposition itself of thickened ink formed in a discharged ink collecting area is hampered to enable unsatisfactory operation to be prevented, thereby being capable of coping with ink relatively excellent in adhering property such as water-resisting ink without resulting in the increased cost and bulkiness of the apparatus.

The discharged ink treating method of the present invention is a method of treating discharged ink from an ink using portion using liquid ink, characterized by the step of destroying or dispersing a deposit of ink created in a discharged ink path along which the discharged ink passes from the ink using portion to the discharged ink receiving portion and on the discharged ink receiving portion side, by the use of a mechanically operated member.

The recovery device of the present invention is a recovery device for collecting discharged ink from an ink using portion using liquid ink or for effecting the recovery of the ink using portion, characterized by a discharged ink receiving portion for receiving the discharged ink, and ink deposition hampering means for acting on said discharged ink receiving portion to operate a mechanically operated member for hampering or destroying the deposition of the ink.

The ink jet recording apparatus of the present invention is an ink jet recording apparatus in which an ink jet recording head is removably mountable or interchangeable or holdable, characterized by means for recovering the ink jet recording head, a discharged ink receiving portion for receiving discharged ink produced by said recovering means, and ink deposition hampering means provided with a mechanically operated member used in said discharged ink receiving portion and for driving said mechanically operated member to thereby hamper or destroy the deposition of the ink.

Particularly, the present invention is an ink jet apparatus having a preliminary discharge area for effecting preliminary discharge for maintaining or recovering a discharge state from a discharge port for discharging ink, characterized in that ink deposition hampering means is provided in said preliminary discharge area (said ink deposition hampering means may be one which imparts the action of stirring, razing, crushing or the like to thickened and deposited ink by a mechanical operation, and specifically may be a gear, a pair of gears, a scraper, a shearing edge or the like) and the ink is hampered from piling to a predetermined or greater height.

Said preliminary discharge area is disposed outside an image forming area for discharging the ink from said discharge port to thereby form an image, and said ink deposition hampering means may be one also having the function as a transmitting mechanism comprising a rotatively operating gear mechanism and transmitting a drive force from a driving portion to other operating portion such as a pump.

Further, said ink deposition hampering means may more effectively be disposed at a location in said preliminary discharge area to which the ink discharged from said discharge port is directly applied.

The above-described ink jet apparatus may be provided with an electro-thermal conversion member for generating heat energy as energy available to discharge the ink from said discharge port, and in such case, film boiling created in the ink by the heat energy applied by said electro-thermal conversion member may be utilized to discharge the ink from said discharge port.

Also, in the above-described ink jet apparatus, as means for preventing said ink deposition hampering means from causing an unsatisfactory operation by the preliminarily discharged ink, design may be made such that the above-noted problems do not arise, for example, in conformity with the integrated value of the discharged ink or that said ink disposition hampering means is driven at any point of time as when the electric power source of the ink jet apparatus is dropped, and it will be more effective if the driving torque at this time is made greater than during other driving time. Preferred specific embodiments of the present invention could be understood from the following description.

In the present invention, a mechanism performing, for example, a mechanical operation such as razing or crushing deposited ink is provided in a discharged ink collecting area, thereby hampering the deposition of the ink and achieving the above object.

The present invention can particularly effectively hamper the ink from being deposited on the preliminary discharge area, by the above-described mechanism and operation, and can also achieve the compactness of the apparatus.

DETAILED DESCRIPTION OF THE PREFERRED EMBODIMENTS (Embodiment 1)

Figure 1:
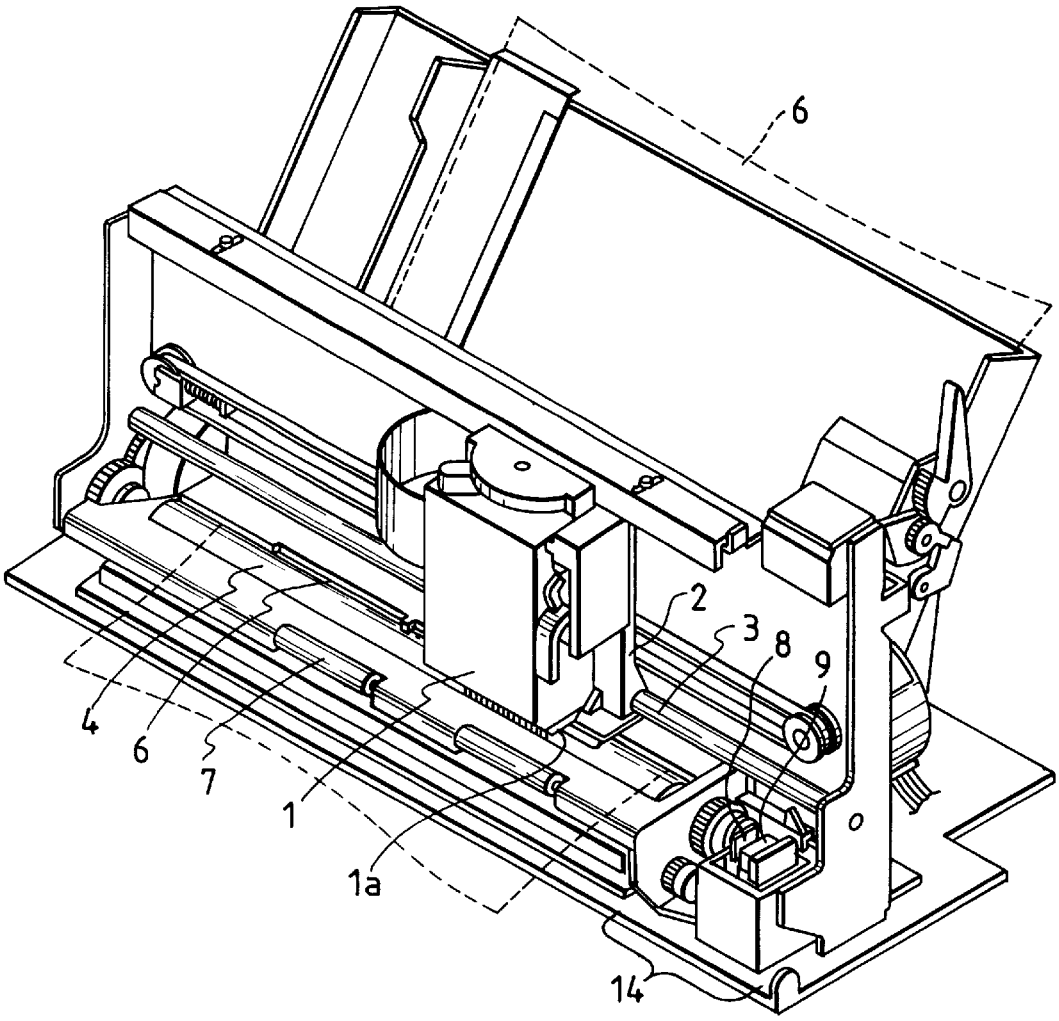
FIG. 1 is a perspective view showing an embodiment of the ink jet apparatus of the present invention.
Figure 2:
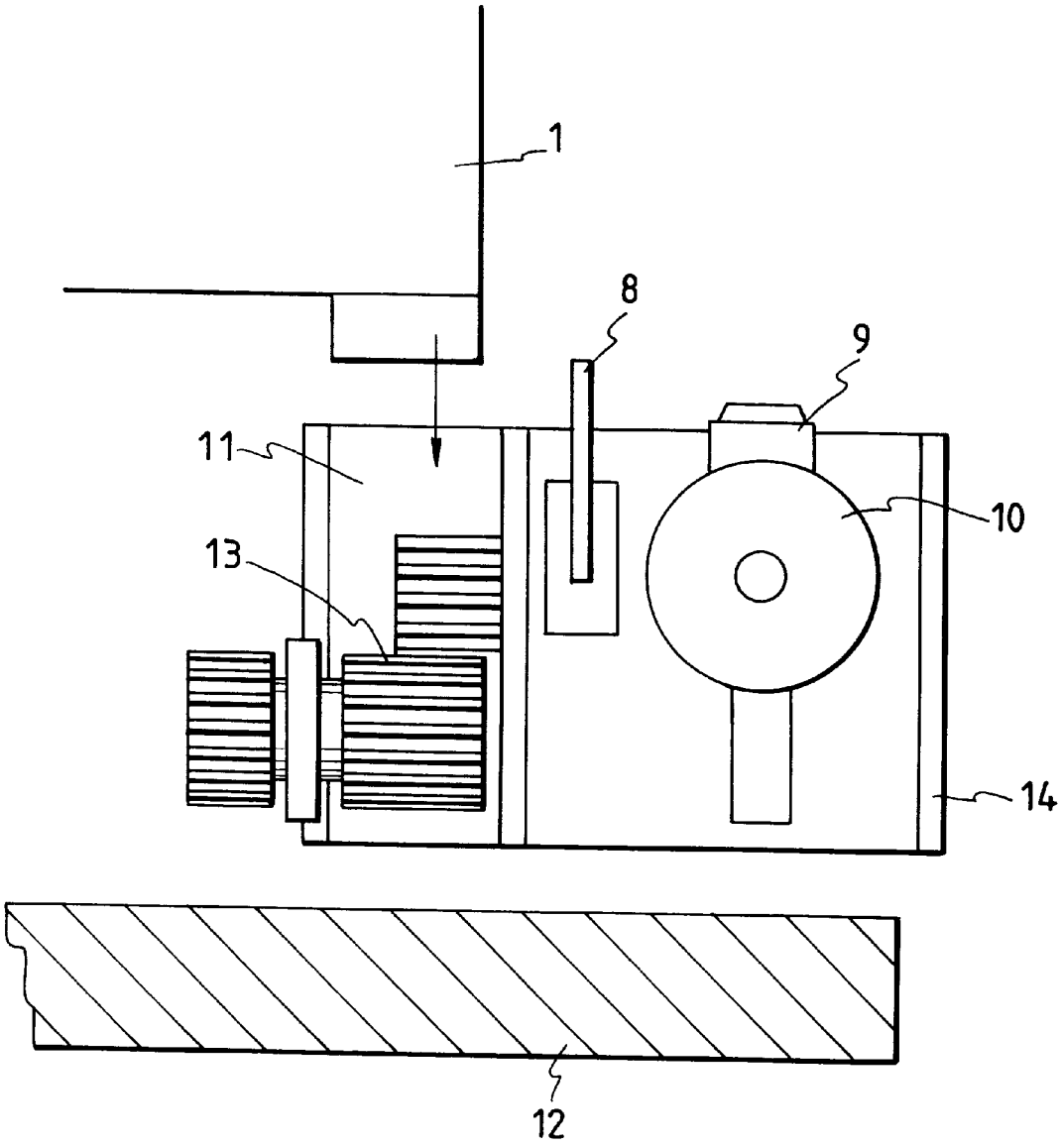
FIG. 2 schematically shows recovering means for a recording head and the structure of the vicinity thereof in the embodiment shown in FIG. 1.
Figure 3:
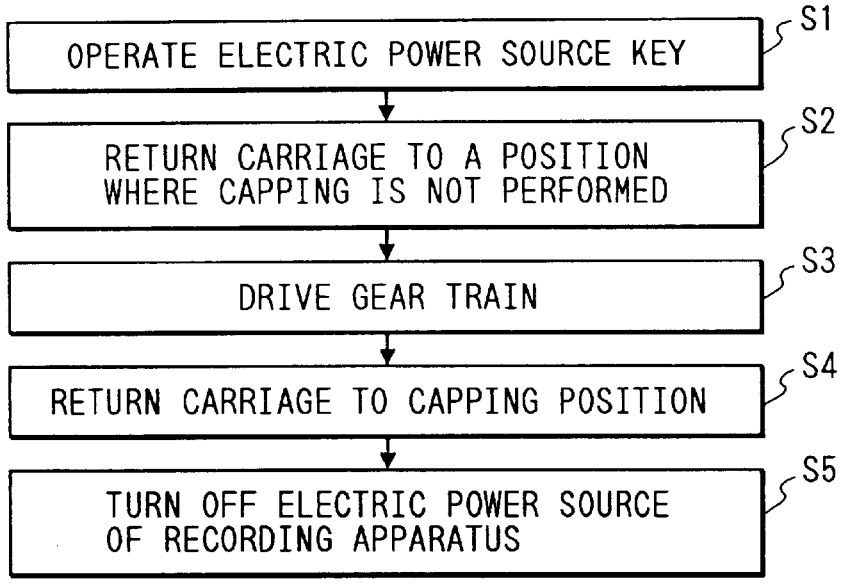
FIG. 3 is a flow chart showing the operation of the embodiment of the present invention.

FIG. 1 is a perspective view showing an embodiment of the ink jet apparatus of the present invention. FIG. 2 schematically shows recovering means for a recording head and the structure of the vicinity thereof in the embodiment shown in FIG. 1, and FIG. 3 is a flow chart showing the controlling operation of a control device for controlling the operation of the embodiment.

In the present embodiment, a recording head 1 for discharging ink from a discharge port in an ink discharge surface 1*a* to thereby record an image on a recording medium 5 is carried on a carriage 2 which is supported by a guide shaft 3 for guiding the carriage in the direction of movement and is reciprocally moved while being opposed to the recording medium 5. The recording medium 5 is urged against a feed roller 4 by a pinch roller 6 and is conveyed by the feed roller 4 being rotated. Further, after image formation, the recording medium 5 is discharged outwardly of the recording apparatus by a discharge roller 7. The recording head 1 is ink jet recording means for discharging the ink by the utilization of heat energy, and is provided with an electro-thermal conversion member for generating heat energy. The recording head 1 discharges the ink from the discharge port to thereby effect recording, by the utilization of a pressure change created by the growth and contraction of a bubble by film boiling created by the heat energy applied by the electro-thermal conversion member.

Figure 4:
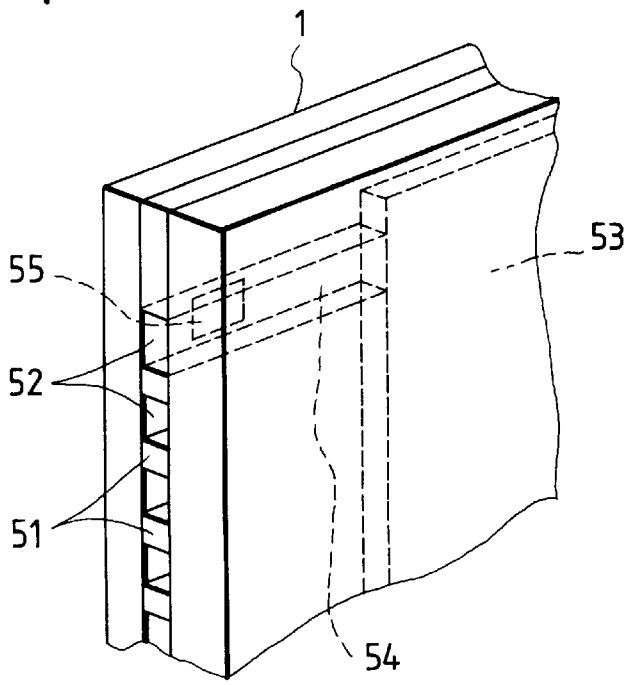
FIG. 4 is a fragmentary perspective view schematically showing the structure of the ink discharging portion of the recording head in the embodiment shown in FIG. 1.

FIG. 4 is a fragmentary perspective view schematically showing the structure of the ink discharging portion of the recording head 1. In FIG. 4, a plurality of discharge ports 52 are formed at a predetermined pitch in a discharge port forming surface 51 (the ink discharge surface 1*a*) facing the recording medium with a predetermined gap (e.g. about 0.5 to 2.0 mm) therebetween, and an electro-thermal conversion member (such as a heat generating resistance member) 55 for generating energy for ink discharge is disposed along the wall surface of each liquid path communicating a common liquid chamber 53 with each discharge port 52.

In the present embodiment, the recording head 1 is carried on the carriage 2 in such positional relationship that the discharge ports 52 are arranged in a direction intersecting the scanning direction of the carriage 2. Thus, there is constructed the recording head 1 in which a corresponding electro-thermal conversion member 55 is driven (electrically energized) on the basis of an image signal or a discharge signal to thereby film-boil the ink in the liquid paths 54 and the ink is discharged from the discharge ports 52 by pressure created at that time.

In the recording apparatus of the present embodiment, recovering means and preliminary auxiliary means for the recording head are provided to stabilize the operation of the recording head 1, and members 8 to 13 in FIGS. 1 and 2 constitute these means. That is, any foreign substance such as paper powder and any excess ink adhering to the ink discharge surface la can be scraped by a wiper 8 which constitutes the recovering means 14. Also, the discharge surface la can be covered with a cap 9 and a pump 10 which constitute the recovering means 14 to thereby prevent the clogging of the discharge ports or suck the ink from the discharge surface 1*a* of the recording head (the sucking operation). Also, by the pump 10 being driven without the discharge surface 1*a* being covered with the cap 9, the ink collected in the cap 9 and pump 10 is discharged (the idle sucking operation). The sucking operation and idle sucking operation are performed after the interchange of the head or after the lapse of a predetermined period during the operation of the apparatus, or when a recovery key on an operation panel is operated. Also, preliminary discharge is effected to a preliminary discharge area 11 at predetermined time intervals before and after the cleaning of the ink discharge surface 1*a* by the wiper 8 or during the recording operation, whereby the stabilization of the quality of output images is achieved. A discharged ink absorbing member 12 is disposed in the lower portion of the preliminary discharge area 11 and the preliminarily discharged ink and the ink discharged from the pump 10 are absorbed and retained by the discharged ink absorbing member 12. That is, this preliminary discharge area 11 is an area particularly provided outside an image forming area, and is for discharging the ink as required for maintaining and recovering the discharged state from the discharge ports, such as preventing the unsatisfactory discharge by the thickening or adhesion of the ink in a nozzle.

Generally, when use is made of ink of high adhering property or high thickening property such as water-resisting ink, thickened ink may be deposited on an ink flow path in the preliminary discharge area or on the discharged ink absorbing member and form a high heap and contact with other members to thereby cause contamination and unsatisfactory operation.

Figure 12:
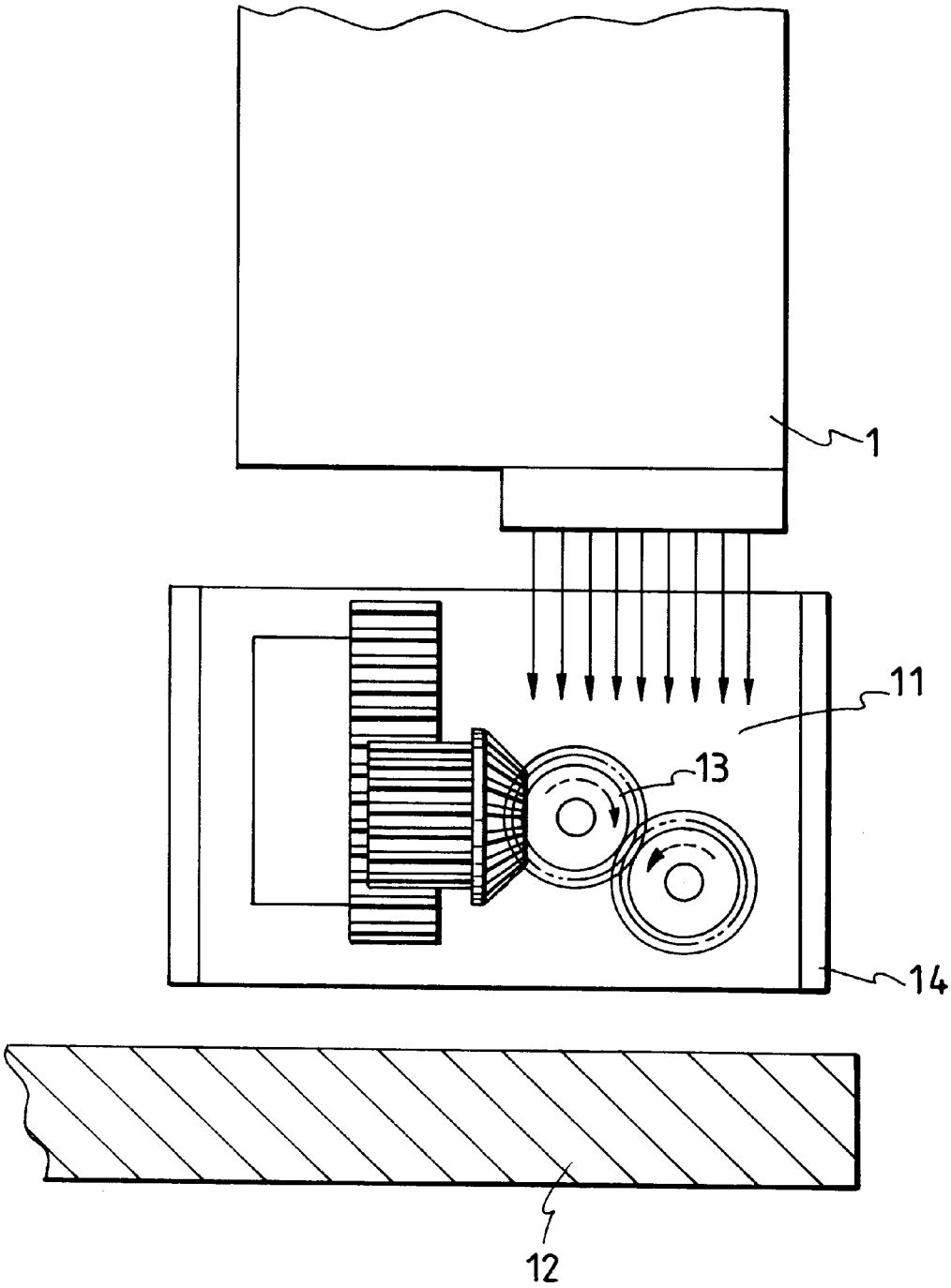
FIG. 12 shows an example of the arrangement of a gear train.

So, a mechanically operated portion for hampering the deposition of ink is provided in the preliminary discharge area 11, and particularly in the present embodiment, a gear train 13 is used as the mechanically operated portion. This gear train 13, as shown in FIG. 12, is disposed at a location above the discharged ink absorbing member 12 and to which the preliminarily discharged ink directly drops. This gear train 13 also functions to transmit the rotational force of the feed roller 4 to the pump 10 when a changeover gear, not shown, is connected to it.

Accordingly, the gear train 13 rotates each time the pump is driven, and by this rotative movement of the gear train 13, the discharged ink is stirred, and when the ink which could not be absorbed up by the discharged ink absorbing member 12 and has been deposited heaps to a height which contacts with the gear train 13, this heap is razed and the deposition of the ink does not grow any further.

Description will now be made of the operation when an electric power source is dropped on the basis of the above-described construction, with reference to FIG. 3. After a series of recording operations have been terminated, the user depresses a power key on the operation panel and tries to stop the recording apparatus (step S1), whereupon the recording apparatus automatically moves the carriage 2 to an idle sucking position (a position in which the pump 10 can be driven and the cap 9 does not cover the discharge surface 1*a* of the head) (step S2), and the pump 10 is driven to thereby shake down the ink adhering onto the gear train 13 (step S3). Thereafter, in order to protect the head 1, the carriage 2 is moved to a position in which the cap 9 covers the discharge surface 1*a* (step S4), and the operation when the electric power source of the recording apparatus is OFF is terminated and thus, the recording apparatus is completely stopped.

As described above, not only during the sucking operation but also when the electric power source of the recording apparatus is dropped, the pump is driven to shake down the ink adhering onto the gear train 13, whereby even when the electric power source is dropped in a state in which the sucking operation does not take place but only the preliminary discharge is effected while the recording apparatus is used, only a small amount of ink adheres onto the gear train 13 and therefore, even if such ink is intactly preserved for a long period, the torque increase by the thickening and adhesion of the ink in the driving portion could be prevented.

Thus, according to the present embodiment, there can be provided an ink jet apparatus in which even when use is made of water-resisting ink or the like which is ready to thicken and adhere, preliminarily discharged ink will not pile to a predetermined or higher level and which will perform a good operation even after the preliminarily discharged ink is preserved for a long period.

(Embodiment 2)

In the construction of Embodiment 1, it is possible that even if the preliminarily discharged ink applied to the gear train 13 is shaken down by the driving of the gear train 13, such ink could not completely be shaken down but more or less of the ink will remain on the gear train 13. Thus, the driving torque of the gear train 13 will increase more or less. Also, the ink deposited on the discharged ink absorbing member 12 is razed by the gear train 13, but in such a case, the deposited ink is always in contact with the gear train 13, and this also leads to an increase in the driving torque.

In the present embodiment, when the gear train 13 is to be driven, the number of revolutions of a motor which is a drive source is usually set so as to be smaller than when the feed roller 4 is driven and so that a great torque may be created.

Figure 5:
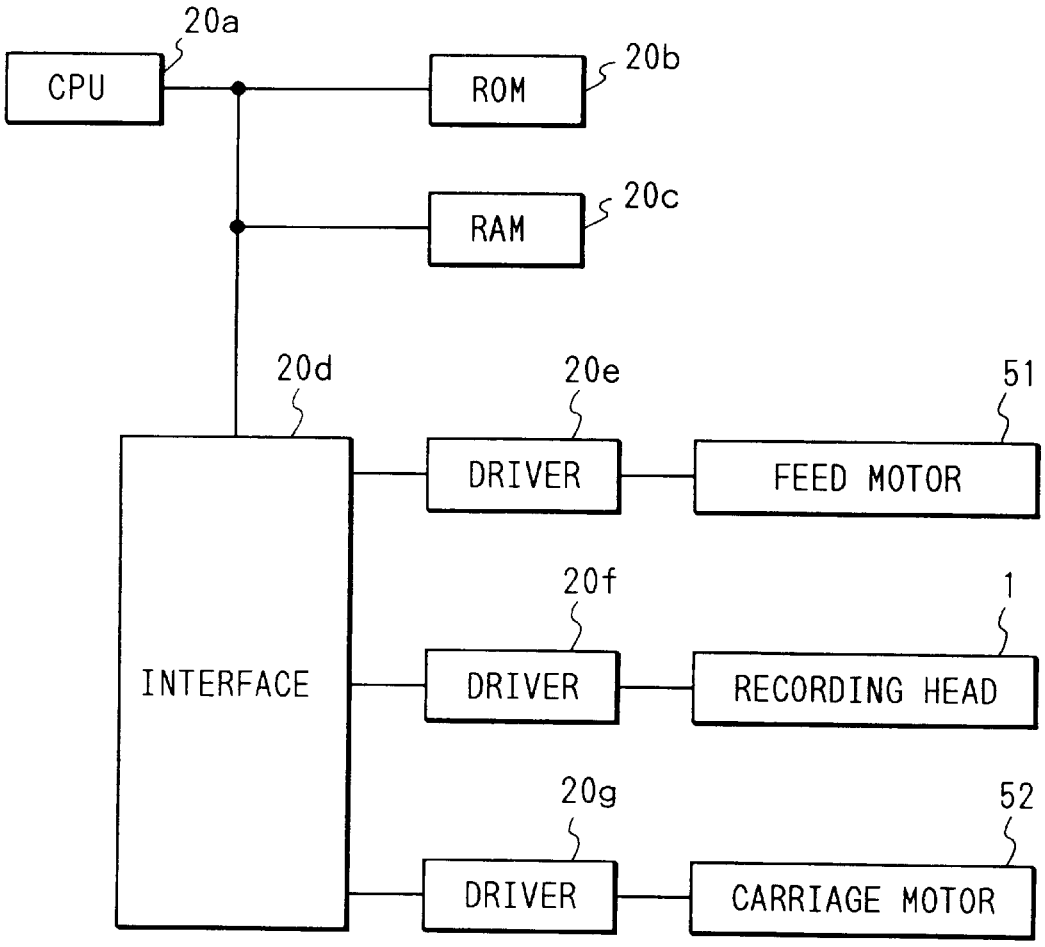
FIG. 5 is a block diagram showing the construction of control means in a second embodiment of the present invention.

FIG. 5 is a block diagram showing control means for effecting what has been described above. The control means shown in FIG. 5 has a CPU 20*a* for effecting the control of the entire recording apparatus, an ROM 20*b* storing therein the control substance of a feed motor and various control data, an RAM 20*c* used as the work area of the CPU 20*a* and temporarily preserving various data, and an interface 20*d*. A feed motor 51 for rotating the feed roller 4 is connected to the interface 20*d* through a driver 20*e*, the recording head 1 is connected to the interface 20*d* through a driver 20*f*, and a carriage motor 52 for driving the carriage 2 is connected to the interface 20*d* through a driver 20*g*.

Figure 6:
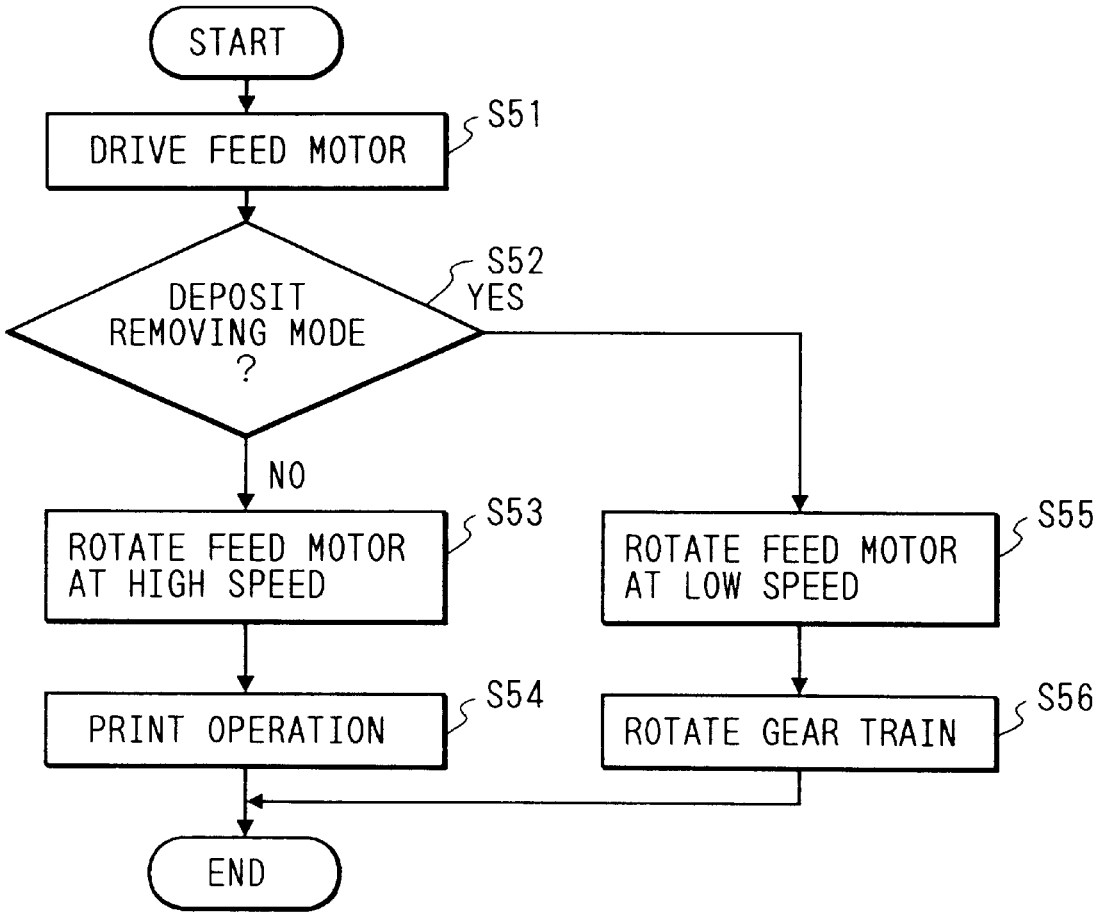
FIG. 6 is a flow chart showing the controlling operation in the second embodiment of the present invention.
Figure 7:
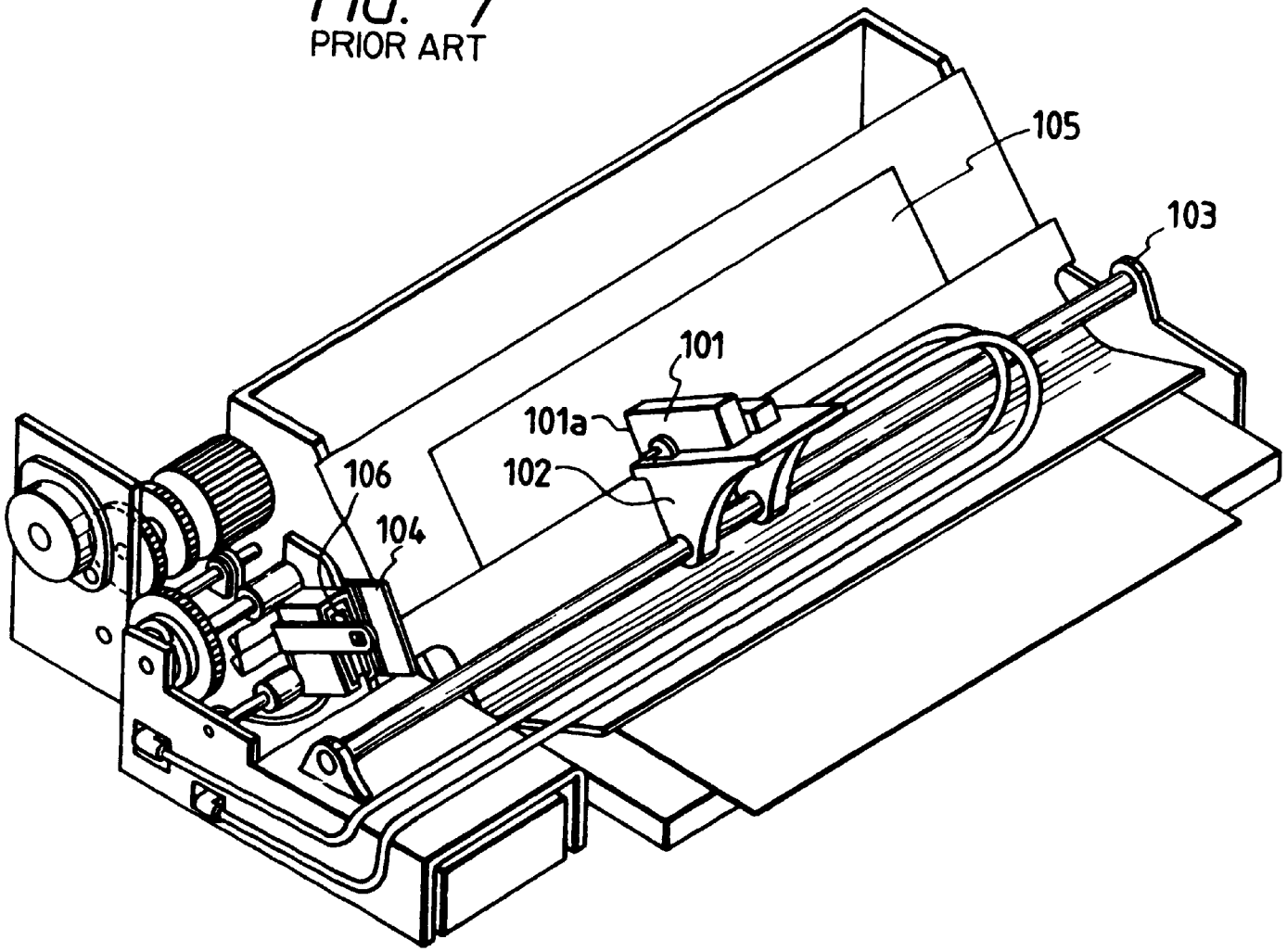
FIG. 7 PRIOR ART
FIG. 7 is a perspective view illustrating an ink jet apparatus according to the prior art.

FIG. 6 is a flow chart showing the drive control of the motor in the present embodiment.

In the flow chart shown in FIG. 6, the number of revolutions of the feed motor 51 is changed to provide a variation in the torque when the feed motor 51 is driven by the aforedescribed construction.

The CPU 20*a,* when it drives the feed motor 51 (step S51), confirms whether the mode is the deposit removing mode for removing the deposit (step S52). If the mode is not the deposit removing mode, the CPU rotates the feed motor at a high speed (step S53) and effects the printing operation, and if the mode is the deposit removing mode, the CPU rotates the feed motor at a low speed (step S55) to thereby rotate the gear train (step S56).

While in the present embodiment, the number of revolutions of the motor is charged to provide a variation in the torque, a similar effect can be obtained by changing the current and voltage to the motor. Further, a similar effect can be obtained by providing a variation in the driving torque only when the power source switch of the recording apparatus is closed.

If as in the present embodiment, a gear mechanism such as the gear train 13 is used as the mechanically operated portion, the growth of the deposit of the thickened ink could be hampered particularly simply and well. Also, if as in the present embodiment, use is made of a mechanically operated portion which functions also as a gear mechanism member for transmitting the drive force from the driving portion to other operating portion, such as transmitting the rotational force of the feed roller 4 through the gear train 13 to drive the pump 10, there will be the advantage that the growth of the deposit of the thickened ink can be hampered well without causing disadvantages such as the increased cost and bulkiness of the apparatus. In the present invention, however, the mechanically operated portion is not restricted thereto, but may be a mechanism for effecting mechanical operations capable of hampering the deposition of the ink (such as the operation of razing the deposited ink and the operation of crushing the deposited ink). As other mechanically operated portion than the gear mechanism, mention may be made, for example, of a rocking mechanism or a sliding mechanism.

Also, there will be obtained advantages such as the simplification and downsizing of the structure of the apparatus by disposing the mechanically operated portion at a location in the preliminary discharge area to which the discharged ink is directly applied, as in the present embodiment.

Also, the present embodiment has been described with respect to an example of the ink jet apparatus for monochromatic recording in which a single recording head 1 is carried on the carriage 2, but the present invention can be likewise applied, irrespective of the number of recording heads, to an ink jet apparatus for color recording which uses a plurality of recording heads for recording with inks of different colors, or an ink jet apparatus for harmony recording which uses a plurality of recording heads for recording with inks of the same color but of different densities, and can achieve a similar operational effect.

Further, as the recording means (recording head) 1, use can likewise be made of recording means and ink tank of whatever construction, such as a construction of the cartridge type in which the recording head and the ink tank are made integral with each other, or a construction in which the recording head and the ink tank are made discrete from each other and are connected together by an ink supply tube, thereby achieving a similar effect.

(Embodiment 3)

Figure 8:
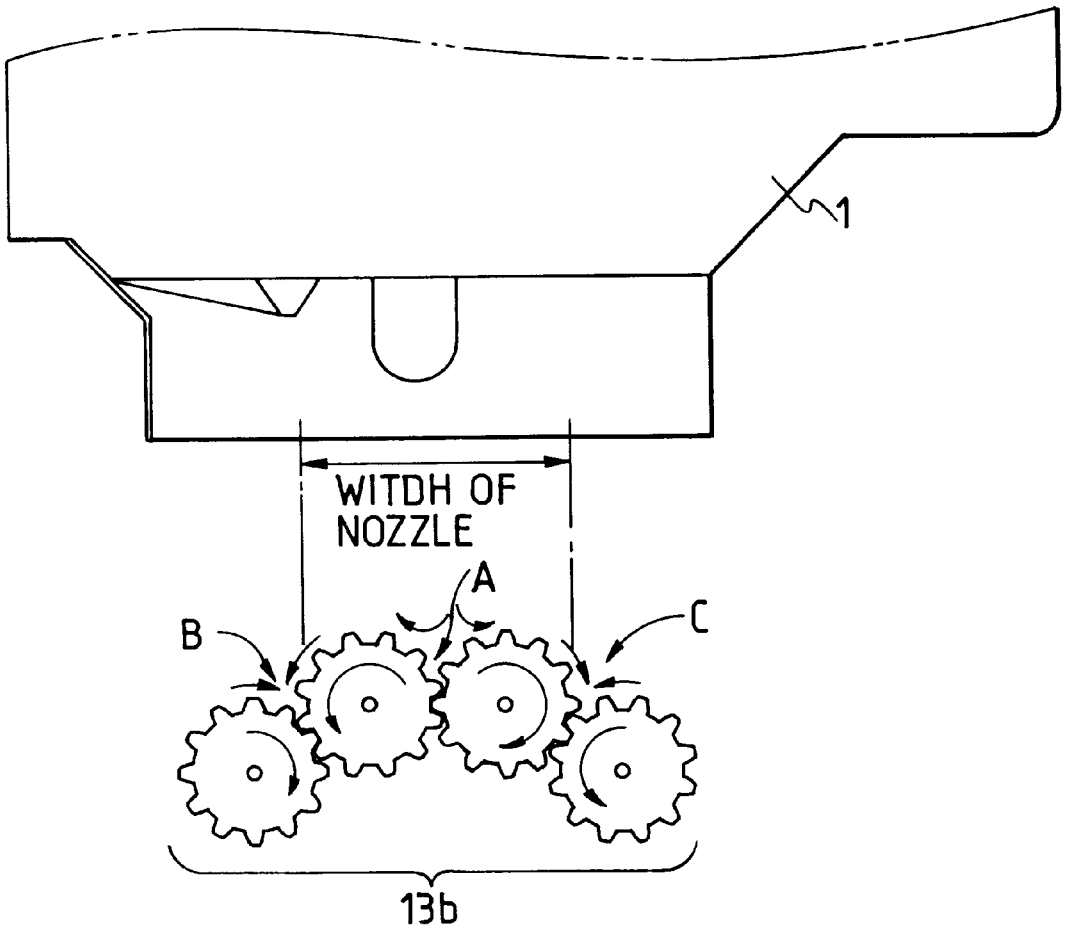
FIG. 8 shows the construction of the essential portions of a third embodiment of the present invention.

The aforedescribed embodiment adopts a construction in which the ink preliminary discharged to the pair of gear trains 13 is shaken down, but alternatively, use may be made of a plurality of pairs of gear trains 13*b* provided with a plurality of portions disposed at locations along the discharge ports of the head as shown in FIG. 8 and capable of destroying ink deposit. In this case, the gears are formed smaller than in the aforedescribed embodiment. The preliminarily discharged ink is first moved to opposite sides by the central pair of gears. The ink is shaken down by the pair of gears on the opposite sides, and is absorbed by a discharged ink absorbing member 12 provided below the gear trains 13*b*.

Due to the above-described construction, the thickness of the gear trains necessary in the vertical direction as viewed in FIG. 8 may be small, and this leads to the downsizing of the apparatus body. Further, the frequency with which the ink adhering to the gears is held between the teeth of the respective gears increases (in the present embodiment, the deposit is divided into sections at a gear contact portion A and is crushed at gear contact portions B and C) and therefore, the effect of shaking down the ink or removing the ink adhering to the gears is enhanced.

In the other points, the construction of the present embodiment is similar to the aforedescribed embodiment.

(Embodiment 4)

Figure 9:
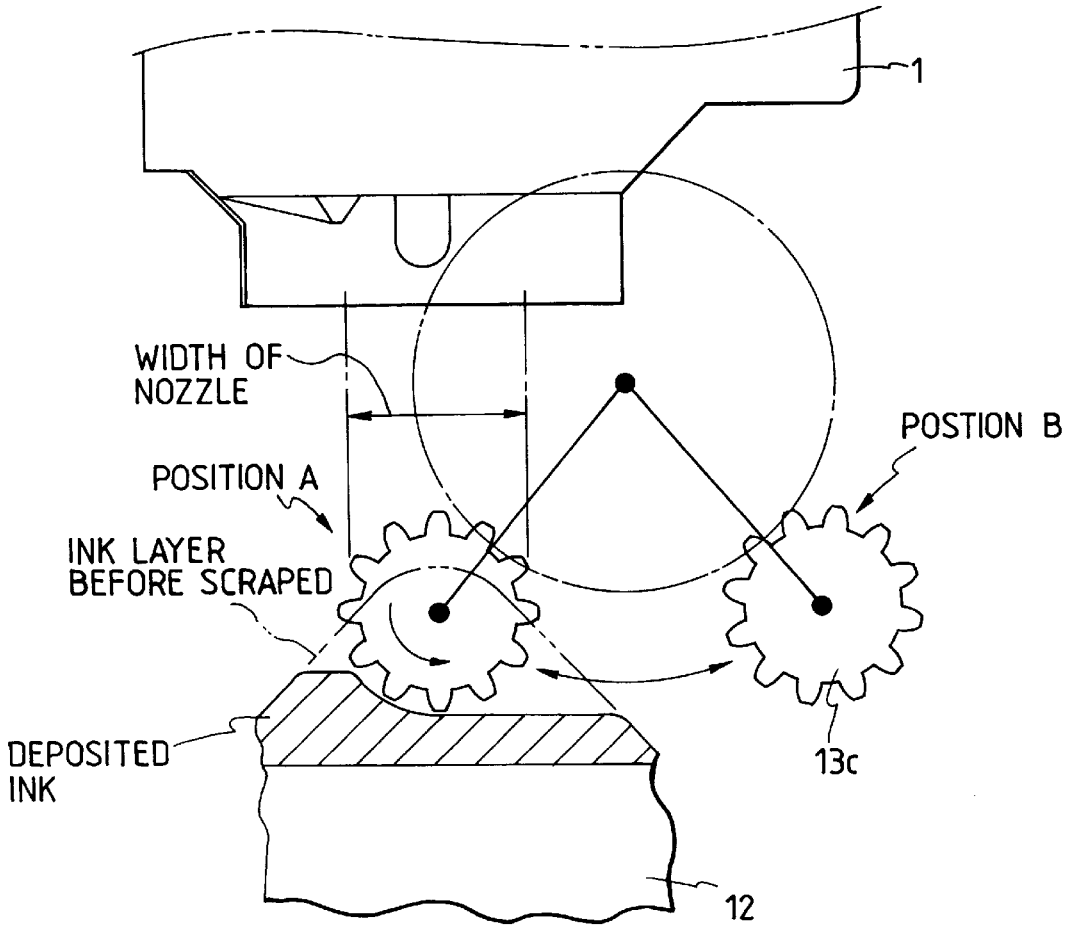
FIG. 9 shows the construction of the essential portions of a fourth embodiment of the present invention.

While Embodiment 1 is of a construction in which the ink preliminarily discharged to a pair of fixed gear trains 13 is shaken down, use may be made of one or more movable gears 13*c* as shown in FIG. 9. First, the ink preliminarily discharged toward the discharged ink absorbing member 12 is gradually deposited on the discharged ink absorbing member 12. The gears 13*c* move from a position B to a position A with a predetermined interval therebetween while being rotated by a pendulum mechanism or the like, not shown, whereby they contact with the deposited ink while rotating (the rotation of the gears 13*c*), thereby scraping and crushing the deposited ink layer. Also, in the position A, the gears 13*c* receive the preliminarily discharged ink, and in the position B, they shake down the deposited ink.

By the above-described construction, the deposited ink can be crushed in a wide range. Further, the preliminarily discharged ink retained can be shaken down in a wide range and therefore, the discharged ink absorbing member 12 can be used more effectively.

In the other points, the construction of the present embodiment is similar to that of Embodiment 1.

(Embodiment 5)

Figure 10:
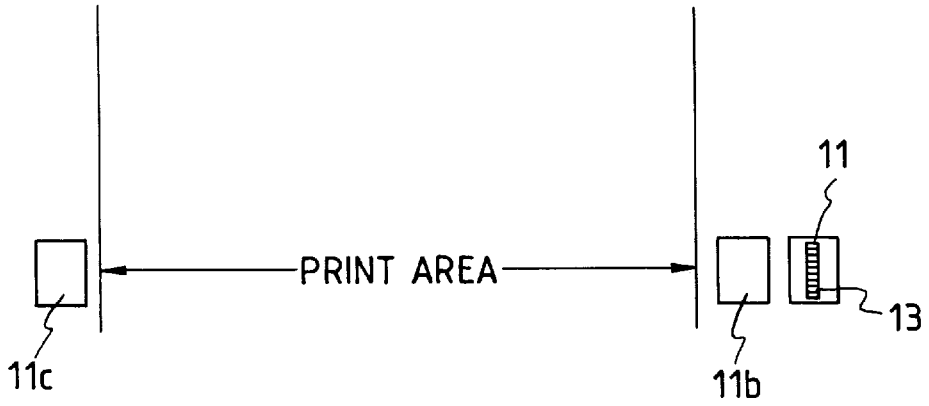
FIG. 10 shows the construction of the essential portions of a fifth embodiment of the present invention.

While the aforedescribed embodiments are of a construction which has only one preliminary discharge area 11 which is an area in which the mechanically operated member of the present invention for destroying or dispersing the ink deposit or preventing the deposition of the ink acts, provision may be made of a plurality of preliminary discharge areas 11 as shown in FIG. 10. In such case, the preliminary discharge area 11*b* is provided more adjacent to the print starting position than to the gear train 13 or the preliminary discharge area 11*c* is provided at the side opposite to the recording sheet. The gear train 13 is not present there, but as in the prior art, only the discharged ink absorbing member 12 is there, and the preliminarily discharged ink directly falls there and is absorbed. These preliminary discharge areas 11*b* and 11*c* are preliminary discharge areas used only during printing, and the other preliminary discharge is effected in the preliminary discharge area 11 wherein the gear train 13 is present, as in the prior art. During printing, the preliminary discharge areas 11*b* and 11*c* to which the carriage is nearer are utilized.

The preliminarily discharged ink only during printing is small as a deposit amount and therefore, even if the gear train 13 is absent, there will be no problem about the life of the apparatus. Further, the preliminary discharge area 11*b* can be provided at a location nearer to the printing area and the movement time necessary for the preliminary discharge during printing may be short and therefore, the whole printing time can be shortened.

In the other points, the construction of the present embodiment is similar to that of the aforedescribed embodiments.

(Embodiment 6)

Figure 11:
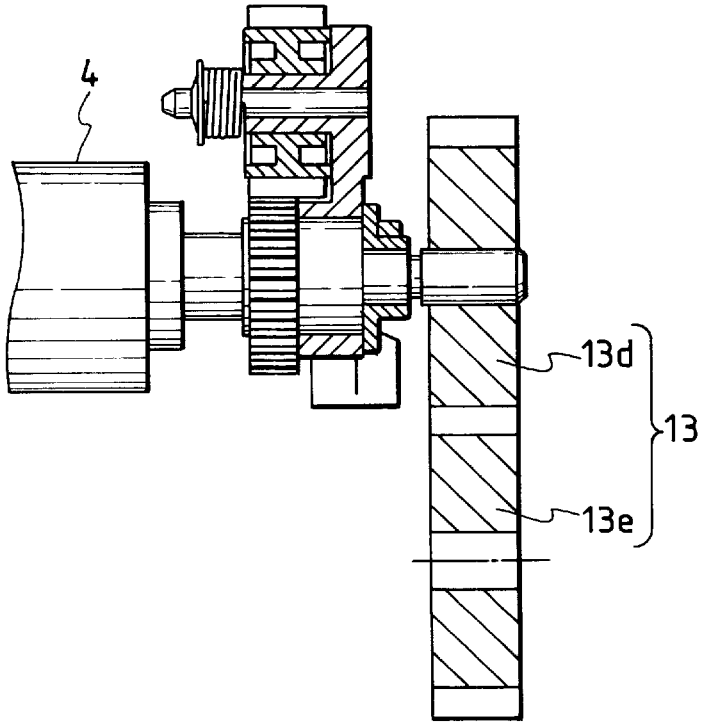
FIG. 11 shows the construction of the essential portions of a sixth embodiment of the present invention.

While in the aforedescribed embodiments, the gear train for driving the recovery system is used as the gear train 13 for treating the preliminarily discharged ink, the gear train 13 for treating the preliminarily discharged ink may be directly provided on the feed roller 4, as shown in FIG. 11. The gear train 13 is comprised of a gear 13*d* forced into the end portion of the feed roller 4, and a gear 13*e* corresponding thereto. In the case of the aforedescribed embodiments, the gear train is rotated only during the operation of the recovery system, while in the case of the present embodiment, the gear train 13 is rotated not only during the operation of the recovery system, but also during paper supply, during paper feeding and during paper discharge and further, the reverse rotating operation is added, whereby in addition to the rotation in the forward direction, the rotation in the reverse direction is added.

By the above-described construction, the time for which the gear train 13 acts on the preliminarily discharged ink is lengthened and also, by the reverse rotating operation being added, the preliminarily discharged ink can be better stirred and shaken off.

In the other points, the construction of the present embodiment is similar to that of the aforedescribed embodiments.

The present invention can also be applied to an apparatus using recording means (a recording head) using an electromechanical conversion member such as a piezo element, if it is an ink jet apparatus, and above all, the present invention brings about an excellent effect in an ink jet apparatus of the type which utilizes heat energy to discharge ink. This is because according to such type, high density and high minuteness of recording can be achieved.

As regards the typical construction and principle of it, it is preferable to carry out by the use of the basic principle disclosed, for example, in U.S. Pat. No. 4,723,129 and U.S. Pat. No. 4,740,796. This system is applicable to any of the so-called on-demand type and continuous type, and particularly in the case of the on-demand type, it is effective because at least one driving signal corresponding to recording information and providing a rapid temperature rise exceeding nuclear boiling is applied to an electro-thermal conversion member disposed correspondingly to a sheet or a liquid path in which liquid (ink) is retained, thereby generating heat energy in the electro-thermal conversion member and causing film boiling in the heat acting surface of recording means (a recording head), with a result that a bubble in the liquid (ink) corresponding at one to one to said driving signal can be formed.

By the growth and contraction of this bubble, the liquid (ink) is discharged through a discharge opening to thereby form at least one drop. When this driving signal is made into a pulse shape, the growth and contraction of the bubble take place appropriately on the spot and therefore, the discharge of the liquid (ink) particularly excellent in responsiveness can be accomplished, and this is more preferable. The driving signal of such pulse shape may suitably be one as described in U.S. Pat. No. 4,463,359 or U.S. Pat. No. 4,345,262. If the conditions described in U.S. Pat. No. 4,313,124 for an invention relating to the temperature rise rate of said heat acting surface are adopted, more excellent recording could be accomplished.

As the construction of the recording head, besides a construction comprising a combination of a discharge port, a liquid path and an electro-thermal conversion member as described in each of the abovementioned patents (a straight liquid flow path or right-angled liquid flow paths), a construction using U.S. Pat. No. 4,558,333 and U.S. Pat. No. 4,459,600 which disclose a construction in which a heat acting portion is disposed in a bent area is also covered by the present invention. In addition, the present invention is also effective when use is made of a construction based on Japanese Laid-Open Patent Application No. 59-1236780 which discloses a construction wherein a slit common to a plurality of electro-thermal conversion members provides the discharge portion of the electro-thermal conversion members or Japanese Laid-Open Patent Application No. 59-138461 which discloses a construction wherein an opening for absorbing the pressure wave of heat energy corresponds to a discharge portion. That is, whatever may be the form of the recording head, according to the present invention, recording becomes capable of being effected reliably and efficiently.

Further, the present invention can also be effectively applied to a recording head of the full line type having a length corresponding to the maximum width of the recording medium on which recording can be effected by a recording apparatus. Such a recording head may be of any of a construction which satisfies that length by a combination of a plurality of recording heads and a construction as a single recording head formed as a unit. In addition, the present invention is also effective when use is made of a recording head of the serial type as described above which is fixed to the apparatus body, or an interchangeable recording head of the chip type which can be electrically connected to the apparatus body and can be supplied with ink from the apparatus body by being mounted on the apparatus body, or a recording head of the cartridge type in which an ink tank is integrally provided in the recording head itself.

Also, the kind or number of recording heads carried may be, for example, only one correspondingly to monochromatic ink, or a plurality of correspondingly to a plurality of inks differing in recording color or density. That is, for example, the recording mode of the recording apparatus is not limited to a recording mode for only the main color such as black, but the recording head may be constructed as a unit or constructed of a combination of a plurality of heads, and the present invention is also very effective for an apparatus provided with at least one of a compound color of different colors and full color by color mixing.

Furthermore, in the above described embodiments of the present invention, the ink has been described as liquid, but use may be made of ink which solidifies at room temperature or below and softens or liquefies at room temperature, or ink which assumes liquid phase when a recording signal in use is imparted thereto, because in the ink jet system, it is usual to temperature-adjust ink itself within a range from 30° C. to 70° C. to thereby effect temperature control so that the viscosity of the ink may be within a stable discharge range. In addition, the temperature rise by heat energy is prevented by being positively used as the energy for the state change of the ink from its solid state to its liquid state, or ink which solidifies when left as it is used for the purpose of preventing the evaporation of the ink, and in any case, the present invention is also applicable when use is made of ink of a property which is liquefied only by heat energy, such as ink which is liquefied by heat energy being imparted thereto correspondingly to a recording signal and is discharged in its liquid state, or ink which already begins to solidify at a point of time which arrives at a recording medium.

The ink in such a case may be in the form as described in Japanese Laid-Open Patent Application No. 54-56847 or Japanese Laid-Open Patent Application No. 60-71260 wherein it is opposed to an electro-thermal conversion member while being retained as liquid or solid in the recesses or through-holes of a porous sheet. In the present invention, what is most effective for the above-described ink is what executes the above-described film boiling system.

Furthermore, the ink jet apparatus according to the present invention may take the form of an apparatus used as the image output terminal of an information processing instrument such as a computer, a copying apparatus combined with a reader or the like and further, a facsimile apparatus having the signal transmitting and receiving functions.

As described above, the present invention not only can provide a recording apparatus in which even when ink of high thickening property and high adhering property is used, thickened ink will not pile to a predetermined or greater height and which will not suffer from the contamination and unsatisfactory operation by deposited ink even if the recording apparatus is preserved for a long period, but also can achieve the above-noted object without resulting in the increased costs and bulkiness of the apparatus.

What is claimed is:

1. A discharged ink treating method comprising the steps of:

providing a preliminary discharge area for effecting a preliminary discharge for maintaining and recovering a discharge state from a discharge port for discharging ink, said preliminary discharge area being disposed outside an image forming area for discharging the ink from said discharge port to thereby form an image;

expelling waste ink from an ink jet head for discharging ink;

directly receiving the expelled waste ink in contact portions between a plurality of members of a mechanically operated portion in said preliminary discharge area; and destroying an ink deposition deposited on the members by changing a contact relation between the members, wherein said mechanically operated portion comprises a gear mechanism which is rotatively operated, and said mechanically operated portion also functions as a gear mechanism member for transmitting a drive force from a driving portion to another operating portion.

2. An ink discharge device, comprising:

a preliminary discharge area for effecting a preliminary discharge for maintaining and recovering a discharge state from a discharge port for discharging ink; and a mechanically operated portion in said preliminary discharge area, said mechanically operated portion having a plurality of members with contact portions therebetween in which waste ink expelled from the discharge port is directly received, said preliminary discharge area being disposed outside an image forming area for discharging the ink from said discharge port to thereby form an image, wherein said mechanically operated portion comprises a gear mechanism which is rotatively operated, and said mechanically operated portion also functions as a gear mechanism member for transmitting a drive force from a driving portion to another operating portion.

3. An ink discharge device according to claim 2, wherein said mechanically operated portion is disposed at a location in said preliminary discharge area to which the ink discharged from said discharge port is directly applied.

4. An ink discharge device according to claim 3, provided with an electro-thermal conversion member for generating heat energy as energy available to discharge the ink from said discharge port.

5. An ink discharge device according to claim 4, wherein the ink is discharged from said discharge port by the utilization of film boiling created in the ink by the heat energy applied by said electro-thermal conversion member.

6. An ink discharge device according to claim 5, further comprising means for improving a preliminarily discharged ink deposit treating ability of said mechanically operated portion.

7. An ink discharge device according to claim 6, wherein said treating ability improving means drives said mechanically operated portion when an electric power source for driving the ink discharge device is dropped.

8. An ink discharge device according to claim 6, wherein said treating ability improving means makes a driving torque of said mechanically operated portion greater than during drive transmission driving.

9. An ink discharge device according to claim 3, further comprising means for improving a preliminarily discharged ink deposit treating ability of said mechanically operated portion.

10. An ink discharge device according to claim 9, wherein said treating ability improving means drives said mechanically operated portion when an electric power source for driving the ink discharge device is dropped.

11. An ink discharge device according to claim 9, wherein said treating ability improving means makes a driving torque of said mechanically operated portion greater than during drive transmission driving.

12. An ink discharge device according to claim 4, further comprising means for improving a preliminarily discharged ink deposit treating ability of said mechanically operated portion.

13. An ink discharge device according to claim 12, wherein said treating ability improving means drives said mechanically operated portion when an electric power source for driving the ink discharge device is dropped.

14. An ink discharge device according to claim 12, wherein said treating ability improving means makes a driving torque of said mechanically operated portion greater than during drive transmission driving.

15. An ink discharge device according to claim 2, provided with an electro-thermal conversion member for generating heat energy as energy available to discharge the ink from said discharge port.

16. An ink discharge device according to claim 7, wherein the ink is discharged from said discharge port by the utilization of film boiling created in the ink by the heat energy applied by said electro-thermal conversion member.

17. An ink discharge device according to claim 16, further comprising means for improving a preliminarily discharged ink deposit treating ability of said mechanically operated portion.

18. An ink discharge device according to claim 17, wherein said treating ability improving means drives said mechanically operated portion when an electric power source for driving the ink discharge device is dropped.

19. An ink discharge device according to claim 17, wherein said treating ability improving means makes a driving torque of said mechanically operated portion greater than during drive transmission driving.

20. An ink discharge device according to claim 15, further comprising means for improving a preliminarily discharged ink deposit treating ability of said mechanically operated portion.

21. An ink discharge device according to claim 20, wherein said treating ability improving means drives said mechanically operated portion when an electric power source for driving the ink discharge device is dropped.

22. An ink discharge device according to claim 20, wherein said treating ability improving means makes a driving torque of said mechanically operated portion greater than during drive transmission driving.

23. An ink discharge device according to any of claim 2, further comprising means for improving a preliminarily discharged ink deposit treating ability of said mechanically operated portion.

24. An ink discharge device according to claim 23, wherein said treating ability improving means drives said mechanically operated portion when an electric power source for driving the ink discharge device is dropped.

25. An ink discharge device according to claim 23, wherein said treating ability improving means makes a driving torque of said mechanically operated portion greater than during drive transmission driving.

26. A recovery device comprising:

a preliminary discharge area for effecting a preliminary discharge for maintaining and recovering a discharge state from a discharge port of an ink jet head for discharging ink, said preliminary discharge area being disposed outside an image forming area for discharging the ink from said discharge port to thereby form an image; and a waste ink receiving portion in said preliminary discharge area for receiving waste ink expelled from the ink jet head, wherein said waste ink receiving portion comprises a mechanically operated portion having a plurality of members and said members directly receive the expelled waste ink in contact portions between said plurality of members, and said mechanically operated portion has a gear mechanism which is rotatively operated, and said mechanically operated portion also functions as a gear mechanism member for transmitting a drive force from a driving portion to another operating portion.

27. An ink jet recording apparatus comprising:

a mounting portion for mounting an ink jet head for discharging ink;

a preliminary discharge area for effecting a preliminary discharge for maintaining and recovering a discharge state from a discharge port of said ink jet head, said preliminary discharge area being disposed outside an image forming area for discharging the ink from said discharge port to thereby form an image; and a waste ink receiving portion in said preliminary discharge area for receiving waste ink expelled from said ink jet head, wherein said waste ink receiving portion comprises a mechanically operated portion having a plurality of members and said members directly receive the expelled waste ink in contact portions between said plurality of members, and said mechanically operated portion has a gear mechanism which is rotatively operated, and said mechanically operated portion also functions a gear mechanism member for transmitting a drive force from a driving portion to another operating portion.

28. An ink jet recording apparatus according to claim 27, wherein said waste ink receiving portion is provided at both ends of a printing area in which said ink jet head prints by reciprocally moving said mounting portion along a reciprocal direction of said mounting portion and said ink jet head is moved to said waste ink receiving portion close to said ink jet head to expel ink.

29. A recovery device comprising:

a preliminary discharge area for effecting a preliminary discharge for maintaining and recovering a discharge state from a discharge port for discharging ink, said preliminary discharge area being disposed outside an image forming area for discharging the ink from said discharge port to thereby form an image; and a waste ink receiving portion in said preliminary discharge area for receiving waste ink expelled from the discharge port, wherein said waste ink receiving portion comprises a mechanically operated portion having a plurality of members with contact portions therebetween in which the waste ink expelled from the discharge port is directly received, and said mechanically operated portion has a gear mechanism which is rotatively operated, and said mechanically operated portion also functions as a gear mechanism member for transmitting a drive force from a driving portion to another operating portion.

30. An ink jet recording apparatus comprising:

a mounting portion for mounting an ink jet head for discharging ink;

a preliminary discharge area for effecting a preliminary discharge for maintaining and recovering a discharge state from a discharge port of the ink let head, said preliminary discharge area being disposed outside an image forming area for discharging the ink from the discharge port to thereby form an image; and a waste ink receiving portion in said preliminary discharge area for receiving waste ink expelled from the discharge port, wherein said waste ink receiving portion comprises a mechanically operated portion having a plurality of members with contact portions therebetween in which the waste ink expelled from the discharge port is directly received, and said mechanically operated portion has a gear mechanism which is rotatively operated, and said mechanically operated portion also functions as a gear mechanism member for transmitting a drive force from a driving portion to another operating portion.

31. A discharged ink treating method comprising the steps of:

expelling waste ink from an ink jet head for discharging ink;

directly receiving the expelled waste ink in contact portions between a plurality of members; and destroying an ink deposition deposited on the members by changing a contact relation between the members while said contact portions are contacted with each other.

32. A device comprising:

a discharge element for effecting a discharge of ink from a discharge port for recording and for effecting a preliminary discharge of ink from said discharge port for maintaining and recovering a discharge state from a discharge port in a preliminary discharge area; and a mechanically operated portion in said preliminary discharge area, said mechanically operated portion having a plurality of members with contact portions therebetween in which waste ink expelled from the discharge port is directly received and in which a contact relation between the members changes while said contact portions are contacted with each other, said preliminary discharge area being disposed outside an image forming area for discharging ink from said discharge port to thereby form an image.

33. A according to claim 32, wherein said mechanically operated portion comprises a gear mechanism which is rotatively operated.

34. A device according to claim 33, wherein said mechanically operated portion also functions as a gear mechanism member for transmitting a drive force from a driving portion to another operating portion.

35. A device according to any one of claims 32–34, wherein said mechanically operated portion is disposed at a location in said preliminary discharge area to which the ink discharge from said discharge port is directly applied.

36. A device according to claim 35, provided with an electro-thermal conversion member for generating heat energy as energy available to discharge ink from said discharge port.

37. A device according to claim 36, wherein the ink is discharged from said discharge port by the utilization of film boiling created in the ink by the heat energy applied by said electro-thermal conversion member.

38. A device according to claim 35, further comprising treating ability improving means for improving a preliminarily discharged ink deposit treating ability of said mechanically operated portion.

39. A device according to claim 38, further comprising an electric power source electrically connected to and for driving the ink discharge device, wherein said treating ability improving means drives said mechanically operated portion when the electric power source is switched off.

40. A device according to claim 38, wherein said treating ability improving means makes a driving torque of said mechanically operated portion greater than during drive transmission driving.

41. A device according to any one of claims 32–34, provided with an electro-thermal conversion member for generating heat energy as energy available to discharge the ink from said discharge port.

42. A device according to claim 41, wherein ink is discharged from said discharge port by utilization of film boiling created in ink by the heat energy applied by said electro-thermal conversion member.

43. A device according to any one of claims 32–34, further comprising treating ability improving means for improving a preliminarily discharged ink deposit treating ability of said mechanically operated portion.

44. A device according to claim 43, further comprising an electric power source electrically connected to and for driving the ink discharge device, wherein said treating ability improving means drives said mechanically operated portion when the electric power source is switched off.

45. A device according to claim 43, wherein said treating ability improving means makes a driving torque of said mechanically operated portion greater than during drive transmission driving.

46. A device comprising a waste ink receiving portion for receiving waste ink expelled from an ink jet head for discharging ink, wherein said waste ink receiving portion has a plurality of members and said members directly receive the expelled waste ink in contact portions between said plurality of members, and wherein a contact relation between the members changes while said contact portions are contacted with each other.

47. An apparatus comprising:

a mounting portion for mounting an ink jet head for discharging ink and expelling waste ink; and a waste ink receiving portion for receiving waste ink expelled from said ink jet head, wherein said waste ink receiving portion has a plurality of members and said members directly receive the expelled waste ink in contact portions between said plurality of members, and wherein a contact relation between the members changes while said contact portions are contacted with each other.

48. An apparatus according to claim 47, wherein said waste ink receiving portion is provided at both ends of a printing area in which said ink jet head prints by reciprocal movement of said mounting portion along a reciprocal direction of said mounting portion and said ink jet head is moved to said waste ink receiving portion closest to said ink jet head to expel ink.

49. A device comprising a waste ink receiving portion for receiving waste ink expelled from a discharge port of an ink jet head for discharging ink, wherein said waste ink receiving portion has a plurality of members with contact portions therebetween in which the waste ink expelled from the discharge port is directly received, and wherein a contact relation between the members changes while said contact portions are contacted with each other.

50. An apparatus comprising:

a mounting portion for mounting an ink jet head for discharging ink and expelling waste ink; and a waste ink receiving portion for receiving waste ink expelled from a discharge port of said ink jet head, wherein said waste ink receiving portion has a plurality of members with contact portions therebetween in which the waste ink expelled from the discharge port is directly received, and wherein a contact relation between the members changes while said contact portions are contacted with each other.

* * * * *

UNITED STATES PATENT AND TRADEMARK OFFICE

CERTIFICATE OF CORRECTION

PATENT NO. : 6,095,635
DATED : August 1, 2000
INVENTOR(S) : Hiroyuki Kinoshita et al.

It is certified that error appears in the above-identified patent and that said Letters Patent is hereby corrected as shown below:

Drawings,
Please replace Figure 1, with the following:

FIG. 1

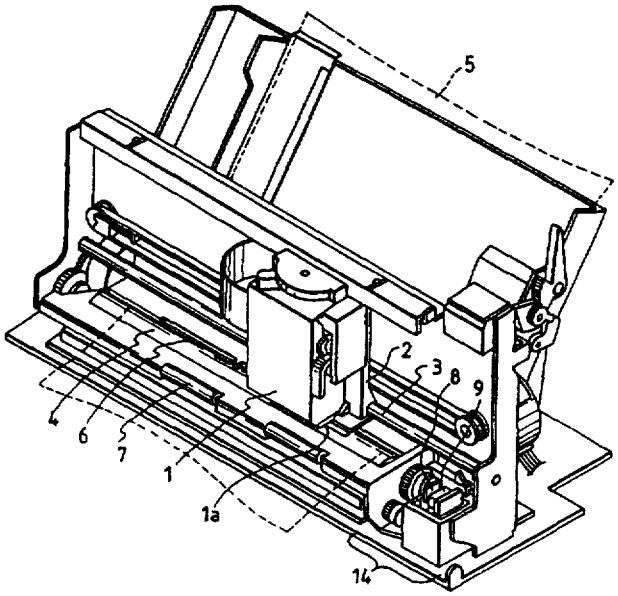

Column 2,
Line 1, change "pa th" to -- path --.

Column 8,
Line 42, delete "of".

Column 9,
Line 66, change "preliminary" to -- preliminarily --.

UNITED STATES PATENT AND TRADEMARK OFFICE

CERTIFICATE OF CORRECTION

PATENT NO. : 6,095,635
DATED : August 1, 2000
INVENTOR(S) : Hiroyuki Kinoshita et al.

It is certified that error appears in the above-identified patent and that said Letters Patent is hereby corrected as shown below:

Column 11,
Line 62, change "take" to -- takes --.

Column 14,
Line 12, change "claim 5," to -- claim 2, --; and
Line 52, change "claim 7," to -- claim 4, --.

Column 15,
Line 12, change "any of claim 2," to -- claim 5, --.

Column 16,
Line 30, change "let" to -- jet --.

Column 17,
Line 6, change "A" to -- A device --.

Signed and Sealed this

Twenty-second Day of January, 2002

*Attest:*

*Attesting Officer*

JAMES E. ROGAN
*Director of the United States Patent and Trademark Office*